US010273636B2

(12) United States Patent
Young et al.

(10) Patent No.: US 10,273,636 B2
(45) Date of Patent: Apr. 30, 2019

(54) HOT FORGED TIE PLATE FOR RAILROAD

(71) Applicant: Yangtze Railroad Materials, Rosedale, MD (US)

(72) Inventors: Patrick Young, Rosedale, MD (US); Zheng Gu, Rosedale, MD (US)

(73) Assignee: Yangtze Railroad Materials, Rosedale, MD (US)

( * ) Notice: Subject to any disclaimer, the term of this patent is extended or adjusted under 35 U.S.C. 154(b) by 246 days.

(21) Appl. No.: 15/245,781

(22) Filed: Aug. 24, 2016

(65) Prior Publication Data

US 2018/0058014 A1 Mar. 1, 2018

(51) Int. Cl.

| | |
|---|---|
| ***E01B 9/40*** | (2006.01) |
| ***B21J 5/02*** | (2006.01) |
| ***E01B 9/02*** | (2006.01) |
| ***E01B 9/46*** | (2006.01) |
| ***B21K 7/08*** | (2006.01) |

(52) U.S. Cl.
CPC *E01B 9/40* (2013.01); *B21J 5/02* (2013.01); *B21K 7/08* (2013.01); *E01B 9/02* (2013.01); *E01B 9/46* (2013.01)

(58) Field of Classification Search
CPC ..... E01B 9/02; E01B 9/40; E01B 9/30; E01B 9/303; E01B 9/306; E01B 9/32; E01B 9/34; E01B 9/46; E01B 9/48; E01B 9/44; E01B 9/483; E01B 9/486
See application file for complete search history.

(56) References Cited

U.S. PATENT DOCUMENTS

RE32,894 E * 3/1989 Gragnami ..... E01B 9/483 238/287
6,974,087 B2 * 12/2005 Faichney ..... E01B 9/48 238/264
2002/0011526 A1 1/2002 Igwemezie
2013/0061989 A1 * 3/2013 Nakamura ..... C21D 8/0226 148/602

FOREIGN PATENT DOCUMENTS

RU 2190720 C2 10/2002

OTHER PUBLICATIONS

Rycrystallization and Grain Growth, Material and Structure, Merion (Year: 1992).*

* cited by examiner

*Primary Examiner* — Mark T Le
(74) *Attorney, Agent, or Firm* — IPro, PLLC; Qian Gu

(57) ABSTRACT

A railroad tie plate has a generally prismatic body including a field side flange and a gauge side flange connected by an intermediate portion. The intermediate portion includes a rail seat for positioning a railroad rail. At least one of the flanges includes a protrusion extending in a thickness dimension of the tie plate. A hole extends into the at least one protrusion so as to receive a retaining device, such as an e-clip. The tie plate is made by hot forging, having a microstructure comprising pearlite and alpha-ferrite. The net shape of the tie plate may be achieved by forging without subsequent material addition and without subsequent material removal.

18 Claims, 8 Drawing Sheets

HOT FORGED TIE PLATE FOR RAILROAD

BACKGROUND

The present disclosure relates to railroads and more particularly to a railroad tie plate to be secured to a railroad tie (also known as a "sleeper") in order to support and locate a rail in relation to the railroad tie (sleeper).

The "background" description provided herein is for the purpose of generally presenting the context of the disclosure. Work of the presently named inventors, to the extent it is described in this background section, as well as aspects of the description which may not otherwise qualify as prior art at the time of filing, are neither expressly nor impliedly admitted as prior art against the present disclosure.

In constructing a railroad, it is conventional to attach parallel sections of rail to supporting members known as railroad ties, or in some locales "sleepers." Railroad ties may be arranged perpendicular to the rails, such that each railroad tie supports two rails. The space between parallel rails forms the gauge of the track.

A rail is sometimes attached to a railroad tie by driving one or more spikes into the railroad tie, each of the one or more spikes having a head or lug to overlap a flange portion of the rail. Plates, known as tie plates, of various shapes are sometimes interposed between rails and railroad ties.

SUMMARY

Under large loads applied to railroad rails by trains traversing them, it has been found that tie plates may be subject to various modes of failure including fatigue and cracking.

A railroad tie plate comprises a generally prismatic body extending in a width dimension of the tie plate between a field side end and a gauge side end. A field side flange on the field side end extends from a bottom surface of the tie plate in a thickness dimension. A gauge side flange on the gauge side end extends from a bottom surface of the tie plate in the thickness dimension. An intermediate portion extends between the field side flange and the gauge side flange. The intermediate portion includes a rail seat on which a railroad rail may rest.

At least one of the field side flange and the gauge side flange includes a spike hole or a screw hole to receive a spike or screw by which the tie plate may be secured to a railroad tie. At least one of the field side flange and the gauge side flange includes a protrusion extending upward in the thickness dimension. The protrusion has a clip-accommodating hole. The clip-accommodating hole is shaped to receive a clip, such as an e-clip, by which a rail may be secured to the rail seat. The gauge side flange, the field side flange, the intermediate portion, and the protrusion have a microstructure characterized by Pearlite and alpha ferrite, free of monotectoid, and having equiaxed grains.

The railroad tie plate has a reduction of area at fracture greater than or equal to 50%. The railroad tie plate has an elongation at break (fracture strain) greater than or equal to 22%. The railroad tie plate has a yield strength greater than or equal to 400 MPa. The railroad tie plate of has an ultimate tensile strength greater than or equal to 650 MPa. The railroad tie plate is formed by hot forging.

The foregoing paragraphs have been provided by way of general introduction, and are not intended to limit the scope of the following claims. The described embodiments, together with further advantages, will be best understood by reference to the following detailed description taken in conjunction with the accompanying drawings.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1:
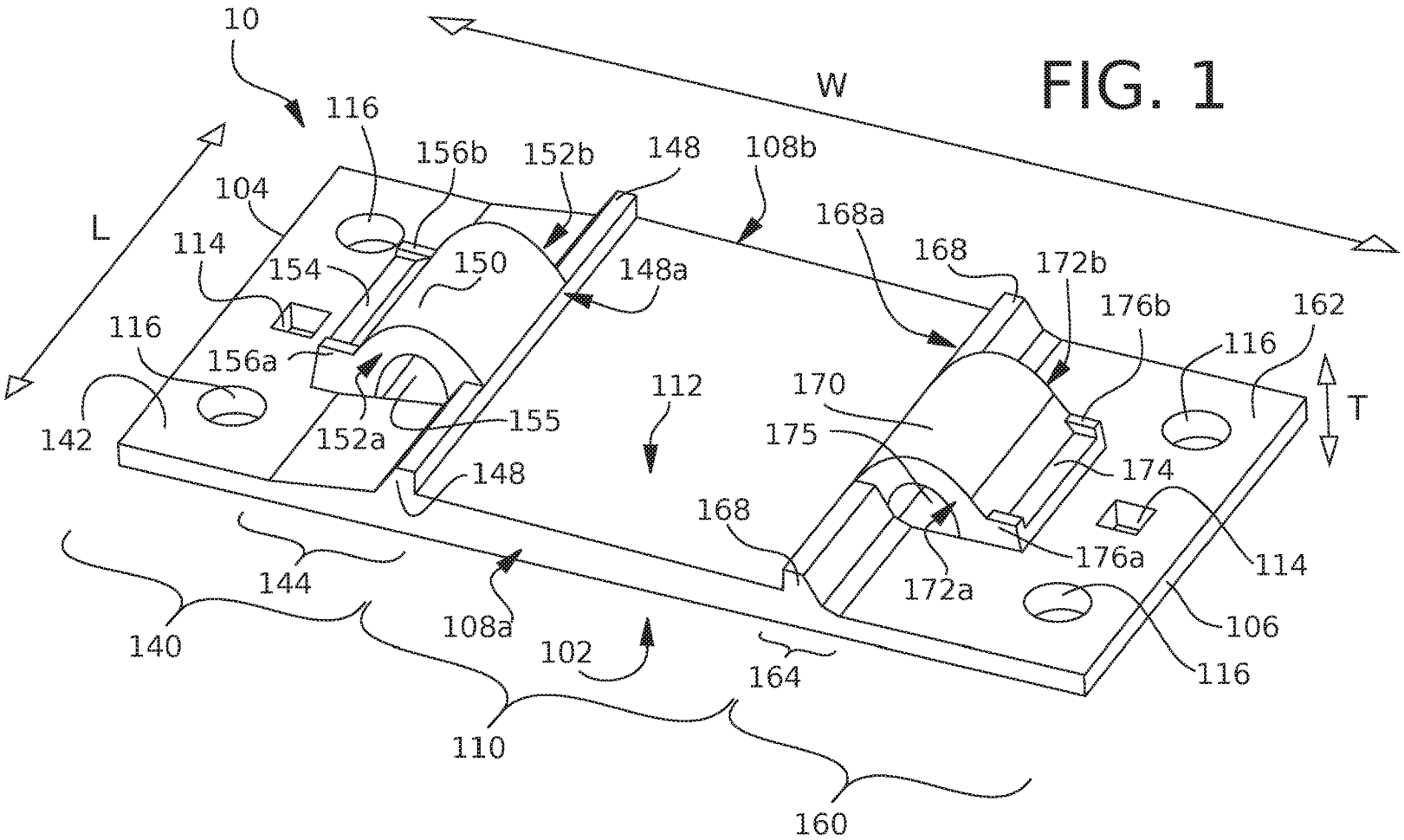
FIG. 1 is a perspective view in accordance with an embodiment.
Figure 2:
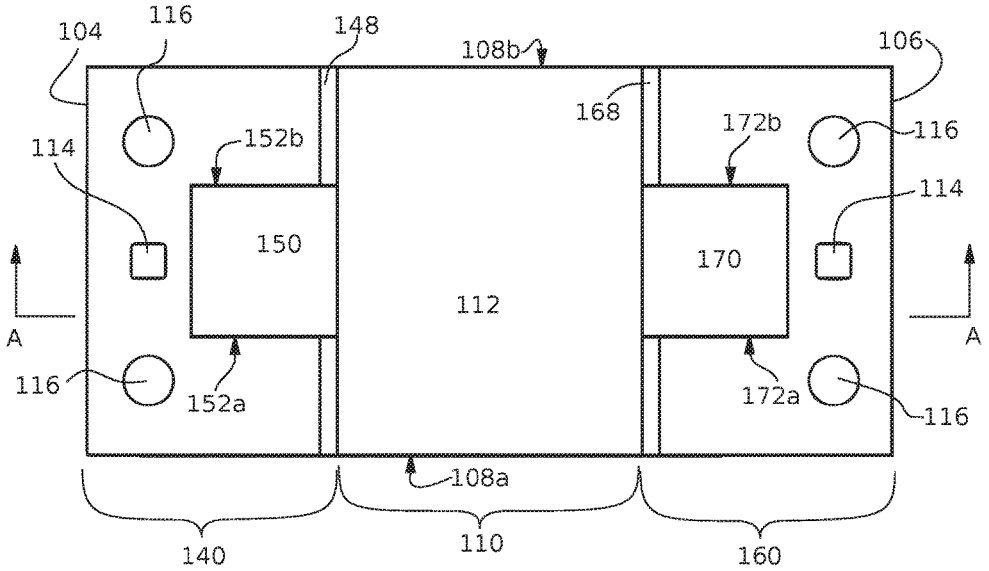
FIG. 2 is a top plan view in accordance with an embodiment.
Figure 3:
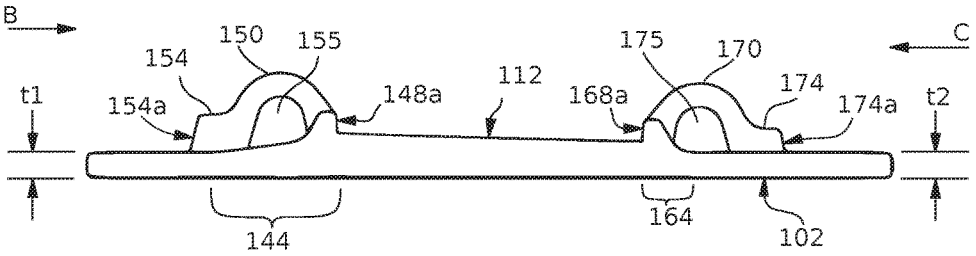
FIG. 3 is front view of the embodiment shown in FIG. 2.

Referring now to the drawings, like reference numerals designate identical or corresponding parts throughout the several views.

Referring to FIG. 1, according to an embodiment, tie plate 10 has a form of a generally rectangular prism of length L, width W, and thickness T. Tie plate 10 extends in width dimension W between field side end 104 and gauge side end 106. Field side end 104 is to be installed on the field side (toward the outside) of a railroad track. Gauge side end 106 is to be installed on the gauge side (toward the space between the rails) of a railroad track.

Tie plate 10 includes intermediate portion 110, field side flange 140, and gauge side flange 160. Intermediate portion 110 includes rail seat 112 on which a railroad rail (not shown) may be seated. The lengthwise dimension of the rail, extending in the direction of travel of a train along the rail, is oriented along lengthwise dimension L of tie plate 10. A railroad tie (sleeper) may abut bottom surface 102 when tie plate 10 is installed. In some embodiments an intermediate substrate, such as a pad or spacer, may be interposed between bottom surface 102 and a railroad tie (sleeper) when tie plate 10 is installed.

In various non-limiting embodiments, an overall length of tie plate 10 may be from 6 to 9 inches, or approximately 7.75 inches; an overall width of tie plate 10 may be from 12 to 20 inches, or approximately 16 inches; and an overall height of tie plate 10 in the thickness direction may be from 1.5 inches to 4 inches, or approximately 2.5 inches. In various non-limiting embodiments, a width of field side flange 140 may be from 3 inches to 7 inches, or approximately 5 inches; a width of intermediate portion 110 may be from 5 inches to 7 inches, or approximately 6.0625 inches; and a width of gauge side flange 160 may be from 3 inches to 7 inches, or approximately 5 inches.

Rail seat 112 may have a surface corresponding in shape to a bottom surface of a rail to be seated thereon. In some embodiments, rail seat 112 may be substantially flat. In other embodiments, rail seat 112 may have a curvature. In some embodiments, rail seat 112 may be canted at an angle sloping from the field side (outside) toward the gauge side (inside) along the width dimension W. In an embodiment, rail seat 112 may be canted at a ratio of 1:40. When installed between a rail and a railroad tie (sleeper), an embodiment may cause a rail resting on rail seat 112 to be angled toward the gauge side (inside) of the railroad track.

Various embodiments of tie plate 10 may be dimensioned to accommodate a rail flange of width between 5 inches and 7 inches. Particular embodiments may be dimensioned for use with 6 inch rail. Other embodiments may be dimensioned for use with 5.5 inch rail. Still other embodiments may be dimensioned for use with 100-8 base rail.

Flange 140 is on the field side (outside) along the width direction W of tie plate 10. Flange 160 is on the gauge side (inside) along the width direction W of tie plate 10. Each of flanges 140 and 160 may include one or more spike holes 114 and one or more screw holes 116. Spike holes 114 may have a generally rectangular shape, for instance a square shape, to accommodate railroad spikes to be driven through each spike hole 114 into a railroad tie (sleeper). Screw holes 116 may have a generally circular shape to accommodate railroad screws to be driven through each screw hole 116 into a railroad tie (sleeper). In some embodiments only spikes or only screws may be used. In other embodiments both spikes and screws may be used. In some embodiments spikes may be inserted through spike holes 114 as an initial means of fixing tie plate 10 to a railroad tie (sleeper) and screws may be inserted later in a subsequent securing step. Insertion and tightening of one or more spikes or screws may be accomplished manually or by means of automated machinery in accordance with various embodiments.

Spike holes 114 and screw holes 116 are non-limiting examples of fixing portions. In other embodiments, a fixing portion configured to receive a fixing device for securing a tie plate to a railroad tie may include one or more of a hole, a slot, a groove, a cavity, a peg, or any other form adapted to interface with a fixing device for securing the tie plate to a railroad tie. Railroad spikes and screws are non-limiting examples of fixing devices. Consistent with various embodiments, a fixing device for securing a tie plate to a railroad tie may include one or more of a spike, a screw, a pin, a staple, a wedge, or any other form adapted to interface with a fixing portion and a railroad tie, to secure the tie plate to the railroad tie.

In various non-limiting embodiments, spike holes 114 may have side lengths from 0.5 inches to 1.5 inches, or approximately 0.6875 inches and screw holes 116 may have diameters from 0.5 inches to 1.5 inches, or approximately 1 inch. In various non-limiting embodiments, field side flange 140 may have a thickness at field side end 104 from 0.25 inches to 1 inch, or approximately 0.5 inches and gauge side flange 160 may have a thickness at gauge side end 106 from 0.25 inches to 1 inch, or approximately 0.5 inches. According to some embodiments, field side flange 140 may have a uniform thickness t1. In other embodiments, flange 140 may have a variable thickness. According to some embodiments, gauge side flange 160 may have a uniform thickness t2. In other embodiments, flange 160 may have a variable thickness. In some embodiments, thickness t1 may be substantially equal to thickness t2. In other embodiments, thickness t1 may differ from thickness t2.

According to some embodiments, field side end face 104 may be essentially vertical, forming a stepped edge. In some embodiments, gauge side end face 106 may be essentially vertical, forming a stepped edge. In other embodiments, end faces 104, 106 may be sloped.

In accordance with various embodiments, field side flange 140 may include flat surface 142 extending along field side end 104 between front edge 108*a* and rear edge 108*b*. In accordance with various embodiments, gauge side flange 160 may include flat surface 162 extending along gauge side end 106 between front edge 108*a* and rear edge 108*b*.

Still referring to FIG. 1, field side flange 140 includes field side shoulder 144 extending upward from flange 140 in thickness dimension T. Field side shoulder 144 further includes field side rib 148 which further extends upward in thickness dimension T from shoulder 144. Rib 148 includes lateral wall 148*a* extending along lengthwise dimension L. Lateral wall 148*a* may provide support to a field side (outside) edge of a railroad rail when the rail is seated on rail seat 112.

In various non-limiting embodiments, field side shoulder 144 may extend from 0.0625 inches to 0.75 inches, or approximately 0.5 inches in the thickness dimension; field side rib 148 may extend from 0.125 inches to 0.75 inches, or approximately 0.5 inches in the thickness dimension; lateral wall 148*a* may have a height from 0.125 inches to 0.75 inches, or approximately 0.5 inches.

Field side flange 140 further includes field side arch 150 which extends upward in thickness direction T from field side flange 140. Arch 150 is a protrusion. Arch 150 is open on at least one of transverse walls 152*a* and 152*b* such that clip-accommodating hole 155 is formed along lengthwise dimension L of arch 150. Clip-accommodating hole 155 is a retaining device accommodating portion. Clip-accommodating hole 155 has a size and shape to accommodate a portion of a retaining device or clip, such as an e-clip. A retaining device or clip, when inserted into clip-accommodating hole 155, may overlap a widthwise portion of a rail, thereby securing the rail in rail seat 112.

Clip-accommodating hole 155 is a non-limiting example of a retaining device accommodating portion. In other embodiments, a retaining device accommodating portion configured to receive a first retaining device for securing a railroad rail to a rail seat may include one or more of a hole, a slot, a cavity, a groove, a buckle, or any other form adapted to interface with a retaining device for securing a railroad rail to a rail seat. An e-clip is a non-limiting example of a retaining device for securing a railroad rail to a rail seat. Consistent with various embodiments, a retaining device for securing a railroad rail to a rail seat may include one or more of a clip, an e-clip, a pin, a screw, a wedge, a buckle, or any other form adapted to interface with a retaining device accommodating portion and a railroad rail to secure the railroad rail to a rail seat.

In various non-limiting embodiments, field side arch 150 may extend from 1 inch to 4 inches in the thickness dimension, or approximately 2 inches above field side flange 140 and outside radius r1 (FIG. 4) of field side arch 150 may be from 0.75 inches to 1.5 inches, or approximately 1 inch. In other embodiments, arch 150 may have side profiles other than curved, such as square. That is, a protrusion having a retaining device accommodating portion in accordance with various embodiments is not limited to a curved arch shape.

In some embodiments field side buttress 154 extends upward in thickness dimension T from flange 140. Buttress 154 is adjacent to arch 150 on the field side (outside). Buttress 154 may provide support to arch 150. In some embodiments, field side buttress 154 may include one or more field side arch supports 156*a* and 156*b*, extending upward in thickness dimension T from buttress 154. Arch supports 156*a*, 156*b* may provide further support to arch 150. In some embodiments, arch supports 156*a*, 156*b* may extend over arch 150 along the width dimension. In other embodiments, arch 150 may have a smooth surface between lateral faces 152*a* and 152*b*. In still other embodiments, field side arch supports may be omitted.

In various non-limiting embodiments, field side buttress 154 may extend from 0.25 to 1.5 inches in the thickness dimension, or approximately 1 inch and each of field side arch supports 156*a*, 156*b* may extend from 0.03125 inches to 0.25 inches, or approximately 0.125 inches. In accordance with various embodiments, lateral face 154*a* of field side buttress 154 may slope away from field side arch 150 toward the field end of tie plate 10. In other embodiments, lateral face 154*a* may be essentially vertical.

Still referring to FIG. 1, gauge side flange 160 includes gauge side shoulder 164 extending upward from flange 160 in thickness dimension T. Gauge side shoulder 164 further includes gauge side rib 168 which further extends upward in thickness dimension T from shoulder 164. Rib 168 includes lateral wall 168*a* extending along lengthwise dimension L. Lateral wall 168*a* may provide support to a gauge side (inside) edge of a railroad rail when the rail is seated on rail seat 112.

In various non-limiting embodiments, gauge side shoulder 164 may extend from 0.0625 inches to 0.75 inches, or approximately 0.25 inches in the thickness dimension, gauge side rib 168 may extend from 0.125 inches to 0.75 inches, or approximately 0.5 inches in the thickness dimension; lateral wall 168*a* may have a height from 0.125 inches to 0.75 inches, or approximately 0.5 inches.

Gauge side flange 160 further includes gauge side arch 170 which extends upward in thickness direction T from gauge side flange 160. Arch 170 is a protrusion. Arch 170 is open on at least one of transverse walls 172*a* and 172*b* such that clip-accommodating hole 175 is formed along lengthwise dimension L of arch 170. Clip-accommodating hole 175 is a retaining device accommodating portion. Clip-accommodating hole 175 has a size and shape to accommodate a portion of a retaining device or clip, such as an e-clip. A retaining device or clip, when inserted into clip-accommodating hole 175, may overlap a widthwise portion of a rail, thereby securing the rail in rail seat 112.

In various non-limiting embodiments, gauge side arch 170 may extend from 1 inch to 4 inches in the thickness dimension, or approximately 2 inches above gauge side flange 160 and outside radius r5 (FIG. 4) of gauge side arch 170 may be from 0.75 inches to 1.5 inches, or approximately 1 inch. In other embodiments, arch 170 may have side profiles other than curved, such as square. That is, a protrusion having a retaining device accommodating portion in accordance with various embodiments is not limited to a curved arch shape.

In some embodiments gauge side buttress 174 extends upward in thickness dimension T from flange 160. Buttress 174 is adjacent to arch 170 on the gauge side (inside). Buttress 174 may provide support to arch 170. In some embodiments, gauge side buttress 174 may include one or more gauge side arch supports 176*a* and 176*b*, extending upward in thickness dimension T from buttress 174. Arch supports 176*a*, 176*b* may provide further support to arch 170. In some embodiments, arch supports 176*a*, 176*b* may extend over arch 170 along the width dimension. In other embodiments, arch 170 may have a smooth surface between lateral faces 172*a* and 172*b*. In still other embodiments, gauge side arch supports may be omitted.

In various non-limiting embodiments, gauge side buttress 174 may extend from 0.25 to 1.5 inches in the thickness dimension, or approximately 1 inch and each of gauge side arch supports 176*a*, 176*b* may extend from 0.03125 inches to 0.25 inches, or approximately 0.125 inches. In accordance with various embodiments, lateral face 174*a* of gauge side buttress 174 may slope away from gauge side arch 170 toward the gauge end of tie plate 10. In other embodiments, lateral face 174*a* may be essentially vertical.

Figure 7:
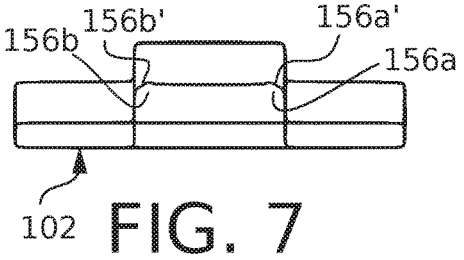
FIG. 7 is a side view of an embodiment, corresponding to view B as indicated in FIGS. 2 and 6.
Figure 8:
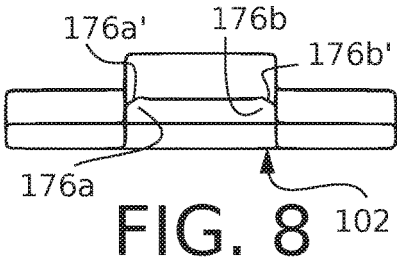
FIG. 8 is a side view of an embodiment, corresponding to view C as indicated in FIGS. 2 and 6.
Figure 9:
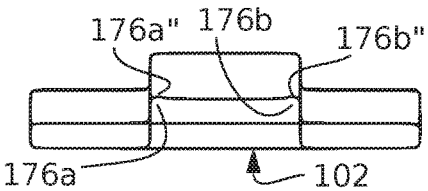
FIG. 9 is a side view in accordance with another embodiment.

In accordance with various embodiments, top surfaces of arch supports may have any of various shapes. Referring now to an embodiment as shown in FIGS. 7 and 8, on the field side, arch support 156*a* includes top surface 156*a*' and arch support 156*b* includes top surface 156*b*'. On the gauge side, arch support 176*a* includes top surface 176*a*' and arch support 176*b* includes top surface 176*b*'. Top surfaces 156*a*' and 176*a*' are beveled at an angle sloping toward front edge 108*a*. Top surfaces 156*b*' and 176*b*' are beveled at an angle sloping toward rear edge 108*b*. Referring to another embodiment as shown in FIG. 9, top surfaces 176*a*" and 176*b*" may be rounded. In other embodiments, top surfaces may be essentially flat (see FIG. 1), or may have another shape.

Figure 4:
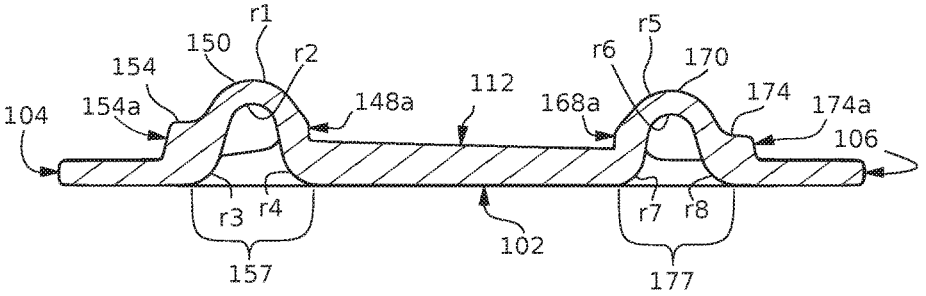
FIG. 4 is a front cutaway view of the embodiment shown in FIGS. 2 and 3, corresponding to view A as indicated in FIG. 2.

Referring now to FIG. 4, field side arch 150 has outside radius r1. Arch 150 includes field side arch indentation 157 on its bottom side. Indentation 157 includes top radius r2, bottom field side radius r3, and bottom gauge side radius r4. In some embodiments, radius r3 may connect directly to radius r2. In some embodiments, radius r4 may connect directly to radius r2. In other embodiments, radius r3 may be connected to radius r2 by an intermediate surface. In still other embodiments, radius r4 may be connected to radius r2 by an intermediate surface. In some embodiments, the intermediate surfaces may be essentially flat. In other embodiments, the intermediate surfaces may have any of various curvatures.

In accordance with various embodiments, indentation 157 (and arch 150) may be formed through a metalworking process in which a lug or protuberance of predetermined size is compressed against bottom surface 102 in order to deform the bottom surface 102 upward in the thickness direction.

In various non-limiting embodiments, radius r2 may be from 0.25 to 0.75 inches, or approximately 0.5 inches, radius r3 may be from 0.25 to 1.5 inches, or approximately 1 inch, and radius r4 may be from 0.25 to 1.5 inches, or approximately 1 inch.

Still referring to FIG. 4, gauge side arch 170 has outside radius r5. Arch 170 includes gauge side indentation 177 on its bottom side. Indentation 177 includes top radius r6, bottom field side radius r7, and bottom gauge side radius r8. In some embodiments, radius r7 may connect directly to radius r6. In some embodiments, radius r8 may connect directly to radius r6. In other embodiments, radius r7 may be connected to radius r6 by an intermediate surface. In still other embodiments, radius r8 may be connected to radius r6 by an intermediate surface. In some embodiments, the intermediate surfaces may be essentially flat. In other embodiments, the intermediate surfaces may have any of various curvatures.

In accordance with various embodiments, indentation 177 (and arch 170) may be formed through a metalworking process in which a lug or protuberance of predetermined size is compressed against bottom surface 102 in order to deform the bottom surface 102 upward in the thickness direction.

In various non-limiting embodiments, radius r6 may be from 0.25 to 0.75 inches, or approximately 0.5 inches, radius r7 may be from 0.25 to 1.5 inches, or approximately 1 inch, and radius r8 may be from 0.25 to 1.5 inches, or approximately 1 inch.

Referring to FIGS. 3, 4, and 6-8, field side rib 148 is higher in thickness dimension T than gauge side rib 168. That is, a first distance along thickness dimension T measured from bottom surface 102 to an apex or pinnacle of rib 148 is greater than a second distance along thickness dimension T measured from bottom surface 102 to an apex or pinnacle of rib 168. In some embodiments, imaginary line K1 connecting a pinnacle of rib 148 to a pinnacle of rib 168 has an inclination matching an inclination of rail seat 112. For example, where rail seat 112 is canted at a ratio of 1:40, imaginary line K1 between ribs 148 and 168 may be parallel to rail seat 112, having a slope corresponding to a 1:40 ratio.

Still referring to FIGS. 3, 4, and 6-8, field side clip-accommodating hole 155 is higher in thickness dimension T relative to bottom surface 102 than gauge side clip-accommodating hole 175. That is, a first distance along thickness dimension T measured from bottom surface 102 to an apex or pinnacle field side clip-accommodating hole 155 is greater than a second distance along thickness dimension T measured from bottom surface 102 to an apex or pinnacle of gauge side clip-accommodating hole 175. Consequently, in some embodiments, a first clip or other retaining device installed in clip-accommodating hole 155 may sit higher than a second clip or other retaining device installed in clip-accommodating hole 175. In some embodiments, imaginary line K2 connecting a pinnacle field side clip-accommodating hole 155 to a pinnacle of gauge side clip-accommodating hole 175 has an inclination matching an inclination of rail seat 112. For example, where rail seat 112 is canted at a ratio of 1:40 in relation to bottom surface 102, imaginary line K2 between holes 155 and 175 may be parallel to rail seat 112, having a slope corresponding to a 1:40 ratio.

Referring to FIGS. 1-6, indentation 157 forms clip-accommodating hole 155 at one or more of transverse walls 152*a* and 152*b*. In an embodiment, hole 155 may extend completely through both transverse walls 152*a* and 152*b*. In another embodiment, hole 155 may extend through transverse wall 152*a*, with transverse wall 152*b* being solid. In still another embodiment, hole 155 may extend through transverse wall 152*b*, with transverse wall 152*a* being solid.

Indentation 177 forms clip-accommodating hole 175 at one or more of transverse walls 172*a* and 172*b*. In an embodiment, hole 175 may extend completely through both transverse walls 172*a* and 172 *b*. In another embodiment, hole 175 may extend through transverse wall 172*a*, with transverse wall 172*b* being solid. In still another embodiment, hold 175 may extend through transverse wall 172*b*, with transverse wall 152*a* being solid.

Figure 5:
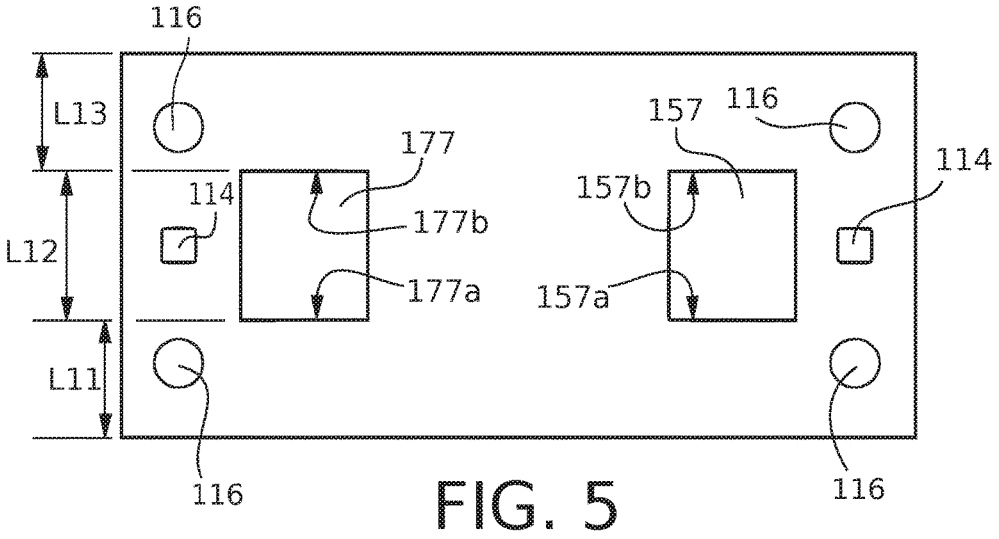
FIG. 5 is a bottom plan view of the embodiment shown in FIGS. 2-4.
Figure 6:
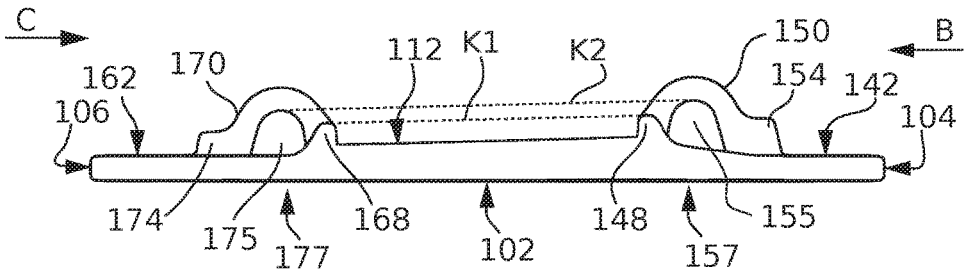
FIG. 6 is a rear view of the embodiment shown in FIGS. 2-5.

Referring to FIG. 5, indentation 157 extends upward from bottom surface 102 between edges 157*a* and 157*b*. Edges 157*a* and 177*a* are spaced apart from front edge 108*a* by a distance corresponding to region L11. Edges 157*b* and 177*b* are spaced apart from rear edge 108*b* by a distance corresponding to region L13.

In various non-limiting embodiments, the region L11 may have a length from 1 to 5 inches, or approximately 2.375 inches; region L12 may have a length from 1 to 5 inches, or approximately 3 inches; and region L13 may have a length from 1 to 5 inches, or approximately 2.375 inches.

In some embodiments, one or more spike holes 114 are located longitudinally within region 12. In some embodiments, one or more spike holes are located in region L11 or in region L13. In some embodiments, one or more screw holes 116 is located longitudinally within regions L11 and L13. In some embodiments, one or more screw holes 116 is located in region L12.

In some embodiments, only one or the other of arches 150 and 170 is present. That is, some embodiments may have a protrusion on one flange, but not on the other. Similarly, in some embodiments, one or more spike holes 114 and screw holes 116 may be located on only one or the other of flanges 140 and 160. That is, some embodiments have a fixing portion on one flange, but not on the other.

Figure 10:
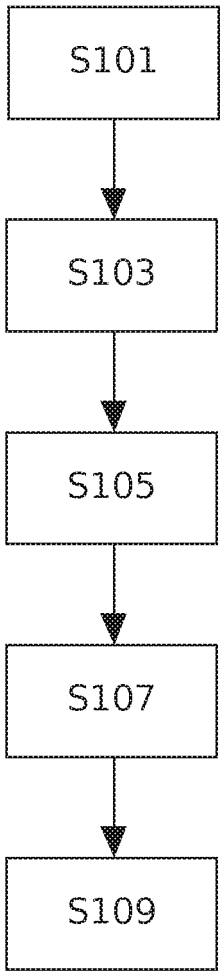
FIG. 10 is a flow chart illustrating steps in accordance with an embodiment.

In accordance with various embodiments, tie plate 10 may be formed by hot forging, without welding, soldering, or heat treatment. Referring to FIG. 10, at S101 a metal blank having predetermined dimensions and heated to a temperature (e.g., about 1050° C.) within a predetermined temperature range (e.g., 1040-1060° C. or 1035-1065° C.) is provided. The metal blank may be produced by any of various processes. In an embodiment, the metal blank may be cut from stock. In another embodiment, the metal blank may be pre-cast as a billet. The metal blank may be heated by any of various means. In embodiments, the metal blank may be pre-heated in an oven, by thermal conduction, by application of gas torches, or by any other heating means. In an embodiment, the metal blank is heated by induction. Induction heating may be easier to control and may lead to more uniform temperature distribution in the metal blank.

Still referring to FIG. 10, at S103 the metal blank is inserted between opposing dies. According to various embodiments, the opposing dies may be vertically opposed with respect to a gravity direction, with a top die and a bottom die accommodating the metal blank therebetween. In other embodiments, the opposing dies may be horizontally opposed, accommodating the metal blank therebetween. In still other embodiments, the opposing dies may be oriented at any of various angles, or may have a dynamic orientation achieved by one or more of rolling, pivoting, and twisting, to accommodate the metal blank.

At S105 the opposing dies are brought into proximity with the metal blank. In various embodiments, any of various means may be employed to achieve a proximal arrangement of the metal blank and the opposing dies. In some embodiments, both of a first and second die may be moved relative to the metal blank. In other embodiments, the metal blank may rest on a first die, and a second die opposing the first die may be moved toward the first die. In various embodiments, the opposing dies may be moved in translation, rotation, or any combination thereof. In some embodiments, the opposing dies may undergo relative motion along a single dimension. In other embodiments, the opposing dies may undergo relative motion along multiple dimensions, i.e., 3D movement.

At S107 pressure is applied to deform the metal blank into a net shape of a tie plate. In some embodiments pressure may be applied by a hydraulic press to one or more of the opposing dies. In other embodiments, a hammer, weight, or other such device may be used.

Referring again to FIGS. 1 and 3, in some embodiments, each of transverse walls 152*a*, 152*b* of field side arch 150 has a flat shear profile. Referring to FIG. 5, in some embodiments, each of transverse walls 157*a*, 157*b* of field side arch indentation 157 has a flat shear profile.

Referring again to FIG. 10, in accordance with various embodiments, the metal blank provided at S101 may extend continuously between front edge 108*a* and rear edge 108*b*. However at S107, discontinuities may be introduced to the metal blank where flange 140 shears apart along a plane including transverse walls 152*a* and 157*a*; and where flange 140 shears apart along a plane including transverse walls 152*b* and 157*b*. Likewise, at S107 discontinuities may be introduced to the metal blank where flange 160 shears apart along a plane including transverse walls 172*a* and 177*a*; and where flange 160 shears apart along a plane including transverse walls 172*b* and 177*b*. Thus, clip accommodation hole 155 may be open through bottom surface 102 of tie plate 10 via indentation 157. Similarly, clip accommodation hole 175 may be open through bottom surface 102 of tie plate 10 via indentation 177.

In accordance with various embodiments, one or more spike holes 114 and one or more screw holes 116 may be formed at S107. In some embodiments, S107 may include punching one or more spike holes 114 or one or more screw holes 116. In other embodiments, one or more spike holes 114 or one or more screw holes 116 may be formed by drilling, punching, broaching, or other material removal processes. In some embodiments, rail seat 112 may be fully formed at S107. In other embodiments, rail seat 112 may be formed by one or more material removal processes including milling, lapping, or scarfing (skiving).

Thus, tie plate 10 may be essentially continuous in the lengthwise direction, apart from one or more spike holes 114 or screw holes 116, in each of regions L11 and L13. In region L12, tie plate 10 may have discontinuous portions corresponding to field side arch 150 (field side arch indentation 157 on bottom surface 102) and gauge side arch 170 (gauge side arch indentation 177 on bottom surface 102).

At S109 tie plate 110 is removed from between the opposing dies. With the net shape of tie plate 10 formed entirely by the end of S107, in some embodiments, tie plate 10 may be completed without need for further welding, soldering, or heat treating steps.

In some embodiments, as tie plate 110 is hot forged, a beneficial microstructure is achieved, imparting desirable mechanical characteristics, which may include reduction of area at fracture greater than or equal to 50%, elongation at breaking (fracture strain) greater than or equal to 22%, yield strength greater than or equal to 400 MPa, and ultimate tensile strength greater than or equal to 650 MPa. Tie plate 110 may have an equiaxed grain structure.

Some embodiments may be substantially free (e.g., having less than 2 weight %, less than 1 weight % or less than 0.5 weight %) of monotectoid. That is, for a given material composition (e.g., cementite) having a given crystal structure (e.g., orthorhombic), the embodiment may be substantially free of other material compositions having the same crystal structure.

Hot forging involves heating a workpiece, other than heating caused by forging itself.

Referring now to FIGS. 11-14, in another embodiment, tie plate 20 has a form of a generally rectangular prism of length L, width W, and thickness T. Tie plate 20 extends in width dimension W between field side end 204 and gauge side end 206. Field side end 204 is to be installed on the field side (toward the outside) of a railroad track. Gauge side end 206 is to be installed on the gauge side (toward the space between the rails) of a railroad track.

Tie plate 20 includes intermediate portion 210, field side flange 240, and gauge side flange 260. Intermediate portion 210 includes rail seat 212 on which a railroad rail (not shown) may be seated. The lengthwise dimension of the rail, extending in the direction of travel of a train along the rail, is oriented along the lengthwise dimension L of tie plate 20. A railroad tie (sleeper) may abut bottom surface 202 when tie plate 20 is installed. In some embodiments an intermediate substrate, such as a pad or spacer, may be interposed between bottom surface 202 and a railroad tie (sleeper) when tie plate 20 is installed.

In various non-limiting embodiments, an overall length of tie plate 20 may be from 6 to 9 inches, or approximately 7.75 inches; an overall width of tie plate 20 may be from 12 to 20 inches, or approximately 16 inches; and an overall height of tie plate 20 in the thickness direction may be from 1.5 inches to 4 inches, or approximately 2.5 inches. In various non-limiting embodiments, a width of field side flange 240 may be from 3 inches to 7 inches, or approximately 5 inches; a width of intermediate portion 210 may be from 5 inches to 7 inches, or approximately 6.0625 inches; and a width of gauge side flange 260 may be from 3 inches to 7 inches, or approximately 5 inches.

Rail seat 212 may have a surface corresponding in shape to a bottom surface of a rail to be seated thereon. In some embodiments, rail seat 212 may be substantially flat. In other embodiments, rail seat 212 may have a curvature. In some embodiments, rail seat 212 may be canted at an angle sloping from the field side (outside) toward the gauge side (inside) along the width dimension W. In an embodiment, rail seat 212 may be canted at a ratio of 1:40. When installed between a rail and a railroad tie (sleeper), an embodiment may cause a rail resting on rail seat 212 to be angled toward the gauge side (inside) of the railroad track.

Various embodiments of tie plate 20 may be dimensioned to accommodate a rail flange of width between 5 inches and 7 inches. Particular embodiments may be dimensioned for use with 6 inch rail. Other embodiments may be dimensioned for use with 5.5 inch rail. Still other embodiments may be dimensioned for use with 100-8 base rail.

Flange 240 is on the field side (outside) along the width direction W of tie plate 20. Flange 260 is on the gauge side (inside) along the width direction W of tie plate 20. Each of flanges 240 and 260 may include one or more spike holes 214 and one or more screw holes 216. Spike holes 214 may have a generally rectangular shape, for instance a square shape, to accommodate railroad spikes to be driven through each spike hole 214 into a railroad tie (sleeper). Screw holes 216 may have a generally circular shape to accommodate railroad screws to be driven through each screw hole 216 into a railroad tie (sleeper). In some embodiments only spikes or only screws may be used. In other embodiments both spikes and screws may be used. In some embodiments spikes may be inserted through spike holes 214 as an initial means of fixing tie plate 20 to a railroad tie (sleeper) and screws may be inserted later in a subsequent securing step. Insertion and tightening of one or more spikes or screws may be accomplished manually or by means of automated machinery in accordance with various embodiments.

In various non-limiting embodiments, spike holes 214 may have side lengths from 0.5 inches to 1.5 inches, or approximately 0.6875 inches and screw holes 216 may have diameters from 0.5 inches to 1.5 inches, or approximately 1 inch. In various non-limiting embodiments, field side flange 240 may have a thickness at field side end 204 from 0.25 inches to 1 inch, or approximately 0.5 inches and gauge side flange 260 may have a thickness at gauge side end 206 from 0.25 inches to 1 inch, or approximately 0.5 inches. According to some embodiments, field side flange 240 may have a uniform thickness. In other embodiments, flange 240 may have a variable thickness. According to some embodiments, gauge side flange 260 may have a uniform thickness. In other embodiments, flange 260 may have a variable thickness. In some embodiments, thicknesses of flanges 240 and 260 may be substantially equal. In other embodiments, thickness of flanges 240 and 260 may differ.

According to some embodiments, field side end face 204 may be essentially vertical, forming a step. In some embodiments, gauge side end face 206 may be essentially vertical, forming a step. In other embodiments, end faces 204, 206 may be sloped.

In accordance with various embodiments, field side flange 240 may include flat surface 242 extending along field side end 204 between front edge 208*a* and rear edge 208*b*. In accordance with various embodiments, gauge side flange 260 may include flat surface 262 extending along gauge side end 206 between front edge 208*a* and rear edge 208*b*.

Figure 11:
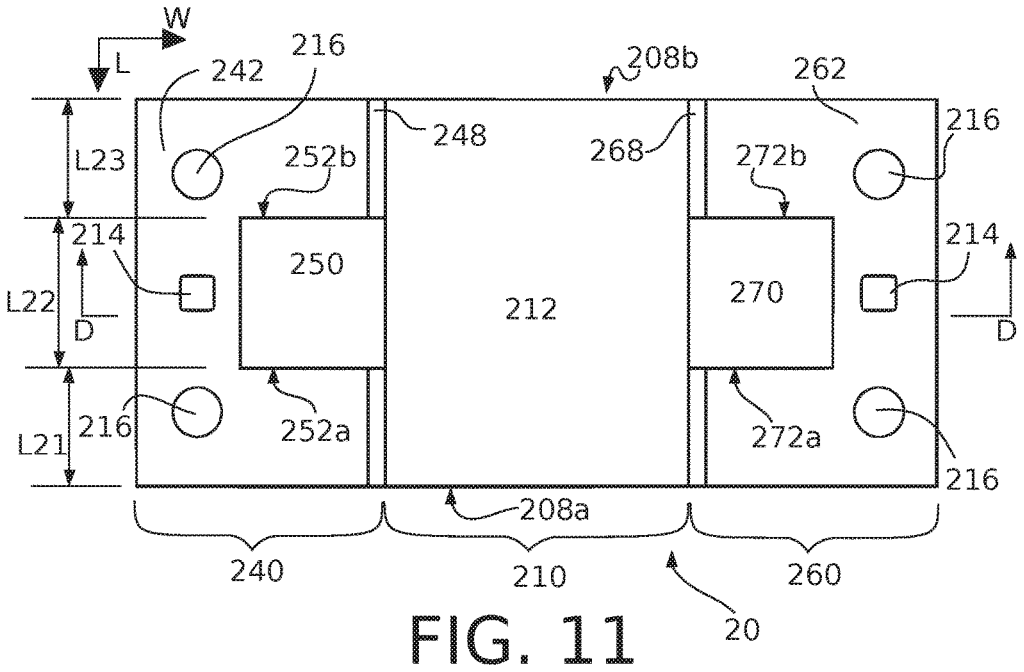
FIG. 11 is a top plan view in accordance with an embodiment.
Figure 12:
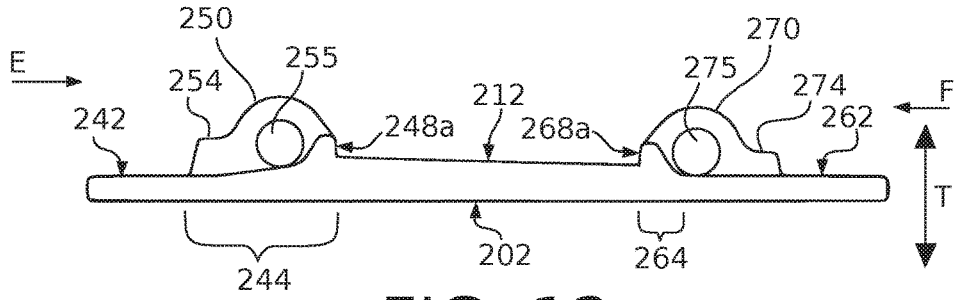
FIG. 12 is a front view of the embodiment shown in FIG. 11.
Figure 13:
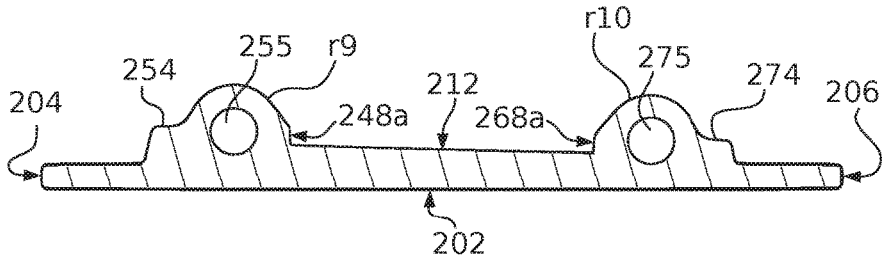
FIG. 13 is a front cutaway view of the embodiment shown in FIGS. 11 and 12, corresponding to view D as indicated in FIG. 11.
Figure 14:
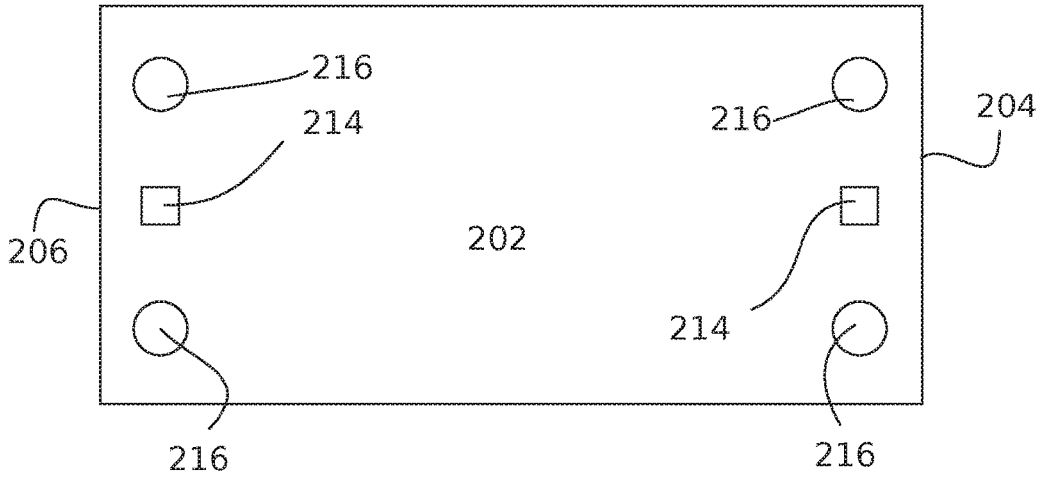
FIG. 14 is a bottom plan view of the embodiment shown in FIGS. 11-13.
Figure 19:
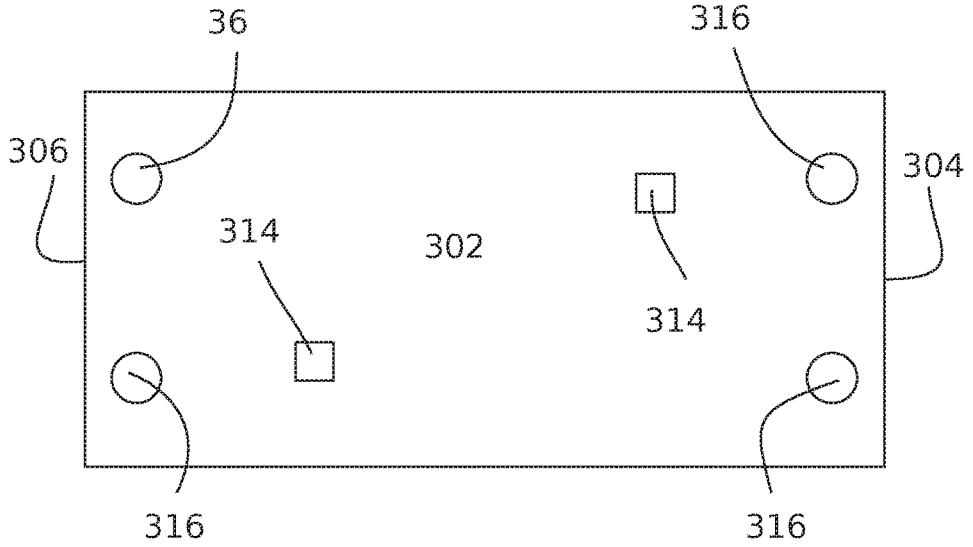
FIG. 19 is a bottom plan view of the embodiment shown in FIGS. 16-18.

Still referring to FIG. 11, field side flange 240 includes field side shoulder 244 extending upward from flange 240 in thickness dimension T. Field side shoulder 244 further includes field side rib 248 which further extends upward in thickness dimension T from shoulder 244. Rib 248 includes lateral wall 248*a* extending along lengthwise dimension L. Lateral wall 248*a* may provide support to a field side (outside) edge of a railroad rail when the rail is seated on rail seat 212.

In various non-limiting embodiments, field side shoulder 244 may extend from 0.0625 inches to 0.75 inches, or approximately 0.5 inches in the thickness dimension; field side rib 248 may extend from 0.125 inches to 0.75 inches, or approximately 0.5 inches in the thickness dimension; lateral wall 248*a* may have a height from 0.125 inches to 0.75 inches, or approximately 0.5 inches.

Field side flange 240 further includes field side arch 250 which extends upward in thickness direction T from field side flange 240. Arch 250 is a protrusion. Arch 250 is open on at least one of transverse walls 252*a* and 252*b* such that clip-accommodating hole 255 is formed along lengthwise dimension L of arch 250. Clip-accommodating hole 255 is a retaining device accommodating portion. Clip-accommodating hole 255 has a size and shape to accommodate a portion of a retaining device or clip, such as an e-clip. A retaining device or clip, when inserted into clip-accommodating hole 255, may overlap a widthwise portion of a rail, thereby securing the rail in rail seat 212.

In various non-limiting embodiments, field side arch 250 may extend from 1 inch to 4 inches in the thickness dimension, or approximately 2 inches above field side flange 240 and outside radius r9 (FIG. 13) of field side arch 250 may be from 0.75 inches to 1.5 inches, or approximately 1 inch. In other embodiments, arch 250 may have side profiles other than curved, such as square. That is, a protrusion having a retaining device accommodating portion in accordance with various embodiments is not limited to a curved arch shape.

In some embodiments field side buttress 254 extends upward in thickness dimension T from flange 240. Buttress 254 is adjacent to arch 250 on the field side (outside). Buttress 254 may provide support to arch 250. In some embodiments, field side buttress 254 may include one or more field side arch supports, extending upward in thickness dimension T from buttress 254. Arch supports may provide further support to arch 250. In other embodiments, field side arch supports may be absent.

In various non-limiting embodiments, field side buttress 254 may extend from 0.25 to 1.5 inches in the thickness dimension, or approximately 1 inch. In accordance with various embodiments, lateral face 254*a* of field side buttress 254 may slope away from field side arch 250 toward the field end of tie plate 20. In other embodiments, lateral face 254*a* may be essentially vertical.

Still referring to FIG. 11, gauge side flange 260 includes gauge side shoulder 264 extending upward from flange 260 in thickness dimension T. Gauge side shoulder 264 further includes gauge side rib 268 which further extends upward in thickness dimension T from shoulder 264. Rib 268 includes lateral wall 268*a* extending along lengthwise dimension L. Lateral wall 268*a* may provide support to a gauge side (inside) edge of a railroad rail when the rail is seated on rail seat 212.

In various non-limiting embodiments, gauge side shoulder 264 may extend from 0.0625 inches to 0.75 inches, or approximately 0.25 inches in the thickness dimension, gauge side rib 268 may extend from 0.125 inches to 0.75 inches, or approximately 0.5 inches in the thickness dimension; lateral wall 268*a* may have a height from 0.125 inches to 0.75 inches, or approximately 0.5 inches.

Gauge side flange 260 further includes gauge side arch 270 which extends upward in thickness direction T from gauge side flange 260. Arch 270 is a protrusion. Arch 270 is open on at least one of transverse walls 272*a* and 272*b* such that clip-accommodating hole 275 is formed along lengthwise dimension L of arch 270. Clip-accommodating hole 275 is a retaining device accommodating portion. Clip-accommodating hole 275 has a size and shape to accommodate a portion of a retaining device or clip, such as an e-clip. A retaining device or clip, when inserted into clip-accommodating hole 275, may overlap a widthwise portion of a rail, thereby securing the rail in rail seat 212.

In various non-limiting embodiments, gauge side arch 270 may extend from 1 inch to 4 inches in the thickness dimension, or approximately 2 inches above gauge side flange 260 and outside radius r10 (FIG. 13) of gauge side arch 270 may be from 0.75 inches to 1.5 inches, or approximately 1 inch. In other embodiments, arch 270 may have side profiles other than curved, such as square. That is, a protrusion having a retaining device accommodating portion in accordance with various embodiments is not limited to a curved arch shape.

In some embodiments gauge side buttress 274 extends upward in thickness dimension T from flange 260. Buttress 274 is adjacent to arch 270 on the gauge side (inside). Buttress 274 may provide support to arch 270. In some embodiments, gauge side buttress 274 may include one or more gauge side arch supports, extending upward in thickness dimension T from buttress 274. Supports may provide further support to arch 270. In other embodiments, gauge side arch supports may be absent.

In various non-limiting embodiments, gauge side buttress 274 may extend from 0.25 to 1.5 inches in the thickness dimension, or approximately 1 inch. In accordance with various embodiments, lateral face 274*a* of gauge side buttress 274 may slope away from gauge side arch 270 toward the gauge end of tie plate 20. In other embodiments, lateral face 274*a* may be essentially vertical.

Referring again to FIGS. 7-9, arch supports of various shapes and sizes may be present on tie plate 20 in like manner as in tie plate 10.

Referring to FIGS. 11-14, field side rib 248 is higher in thickness dimension T than gauge side rib 268. That is, a first distance along thickness dimension T measured from bottom surface 202 to an apex or pinnacle of rib 248 is greater than a second distance along thickness dimension T measured from bottom surface 202 to an apex or pinnacle of rib 268. In some embodiments, an imaginary line connecting a pinnacle of rib 248 to a pinnacle of rib 268 has an inclination matching an inclination of rail seat 212. For example, where rail seat 212 is canted at a ratio of 1:40, the imaginary line between ribs 248 and 268 may be parallel to rail seat 212, having a slope corresponding to a 1:40 ratio.

Still referring to FIGS. 11-14, field side clip-accommodating hole 255 is higher in thickness dimension T than gauge side clip-accommodating hole 275. That is, a first distance along thickness dimension T measured from bottom surface 202 to an apex or pinnacle of clip-accommodating hole 255 is greater than a second distance along thickness dimension T measured from bottom surface 202 to an apex or pinnacle of clip-accommodating hole 275. Consequently, a first clip or other retaining device installed in clip-accommodating hole 255 may sit higher than a second clip or other retaining device installed in clip-accommodating hole 275. In some embodiments, an imaginary line connecting a pinnacle of hole 255 to a pinnacle of hole 275 has an inclination matching an inclination of rail seat 212. For example, where rail seat 212 is canted at a ratio of 1:40 in relation to bottom surface 202, the imaginary line between holes 255 and 275 may be parallel to rail seat 212, having a slope corresponding to a 1:40 ratio in relation to bottom surface 202.

In some embodiments, one or more spike holes 214 are located longitudinally within region 22. In some embodiments, one or more spike holes are located in region L21 or in region L23. In some embodiments, one or more screw holes 216 is located longitudinally within regions L21 and L23. In some embodiments, one or more screw holes 216 is located in region L22.

In some embodiments, only one or the other of arches 250 and 270 is present. That is, some embodiments have a protrusion on one flange, but not on the other. Similarly, in some embodiments, one or more spike holes 214 and screw holes 216 is located on only one or the other of flanges 240 and 260. That is, some embodiments have a retaining device accommodating portion on one flange, but not on the other.

In some embodiments, clip-accommodating holes 255 and 275 may be formed by one or more forging processes. In other embodiments, holes 255 and 275 may be formed by one or more material removal processes, such as milling or drilling.

Referring now to FIGS. 15-19, in some embodiments, one or more protrusions may be located adjacent to front edge 308*a* of tie plate 30 and one or more protrusions may be located adjacent to rear edge 308*b* of tie plate 30. More particularly, in various embodiments, field side arch 350 may adjoin front edge 308*a*. Likewise, gauge side arch 370 may adjoin rear edge 308*b*.

Figure 15:
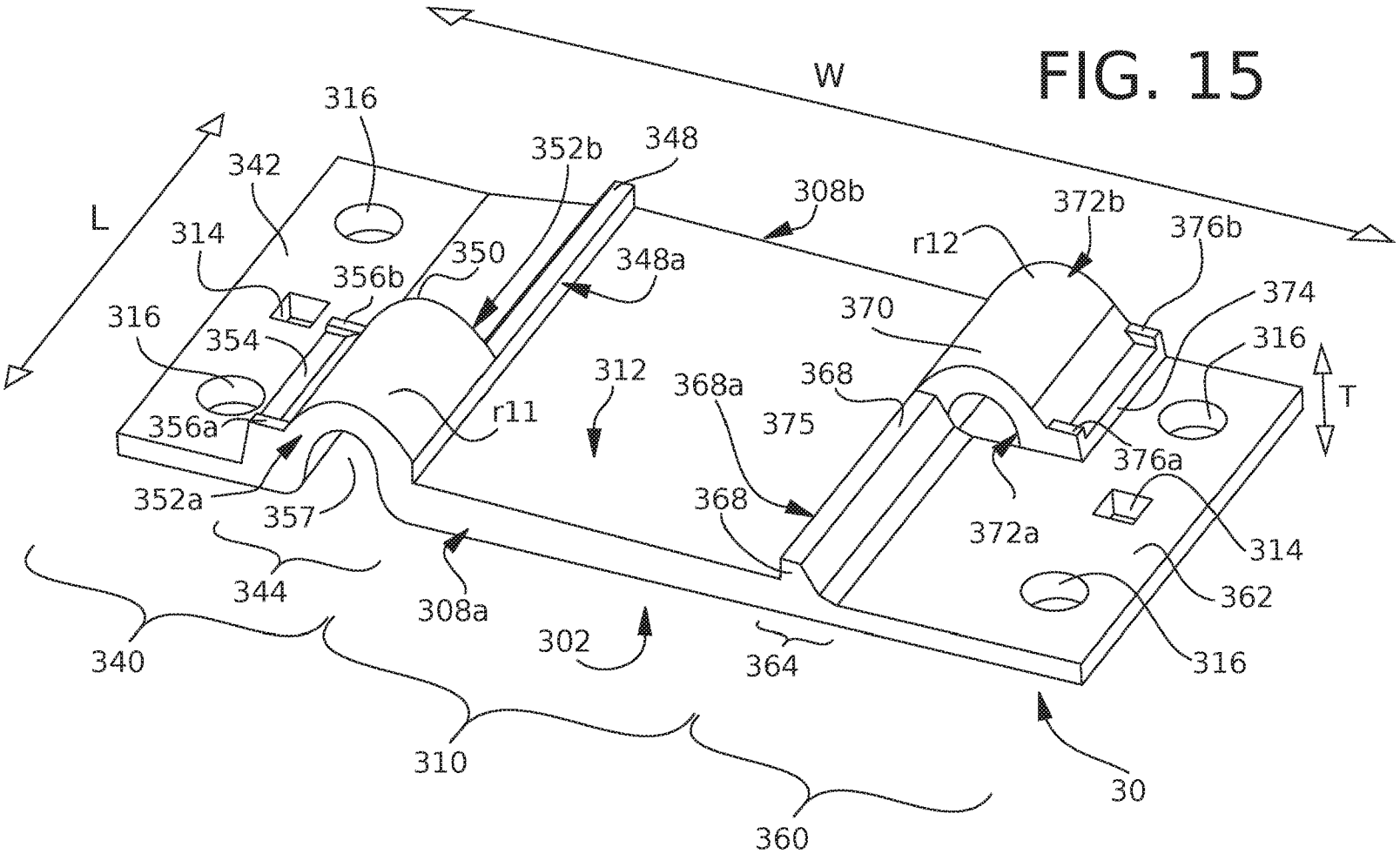
FIG. 15 is a perspective view in accordance with an embodiment.
Figure 16:
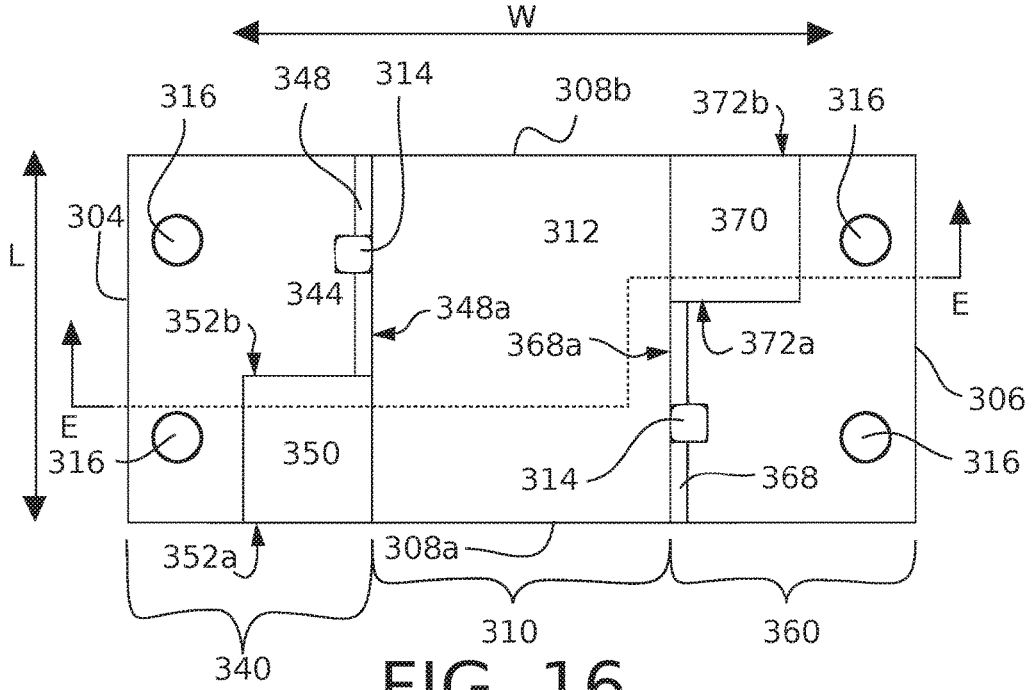
FIG. 16 is a top plan view in accordance with another embodiment.
Figure 17:
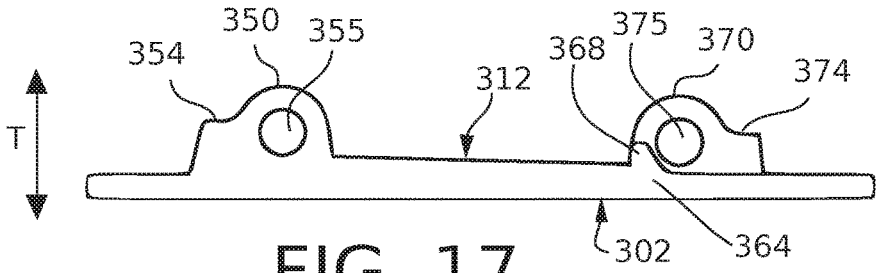
FIG. 17 is a front view of the embodiment shown in FIG. 16.
Figure 18:
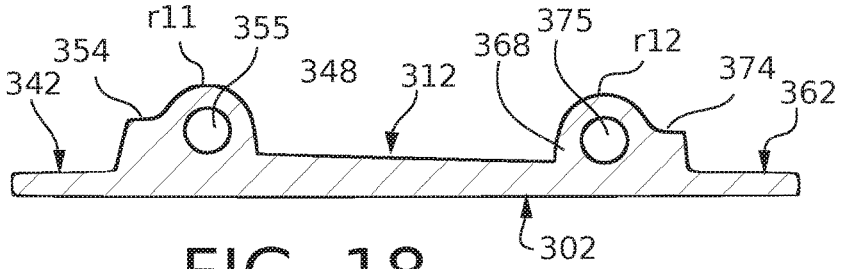
FIG. 18 is a front cutaway view of the embodiment shown in FIGS. 16 and 17, corresponding to view E as indicated in FIG. 16.

Referring to FIG. 15, according to an embodiment, tie plate 30 has a form of a generally rectangular prism of length L, width W, and thickness T. Tie plate 30 extends in width dimension W between field side end 304 and gauge side end 306. Field side end 304 is to be installed on the field side (toward the outside) of a railroad track. Gauge side end 306 is to be installed on the gauge side (toward the space between the rails) of a railroad track.

Tie plate 30 includes intermediate portion 310, field side flange 340, and gauge side flange 360. Intermediate portion 310 includes rail seat 312 on which a railroad rail (not shown) may be seated. The lengthwise dimension of the rail, extending in the direction of travel of a train along the rail, is oriented along lengthwise dimension L of tie plate 30. A railroad tie (sleeper) may abut bottom surface 302 when tie plate 30 is installed. In some embodiments an intermediate substrate, such as a pad or spacer, may be interposed between bottom surface 302 and a railroad tie (sleeper) when tie plate 30 is installed.

In various non-limiting embodiments, an overall length of tie plate 30 may be from 6 to 9 inches, or approximately 7.75 inches; an overall width of tie plate 30 may be from 12 to 20 inches, or approximately 16 inches; and an overall height of tie plate 30 in the thickness direction may be from 1.5 inches to 4 inches, or approximately 2.5 inches. In various non-limiting embodiments, a width of field side flange 340 may be from 3 inches to 7 inches, or approximately 5 inches; a width of intermediate portion 310 may be from 5 inches to 7 inches, or approximately 6.0625 inches; and a width of gauge side flange 360 may be from 3 inches to 7 inches, or approximately 5 inches.

Rail seat 312 may have a surface corresponding in shape to a bottom surface of a rail to be seated thereon. In some embodiments, rail seat 312 may be substantially flat. In other embodiments, rail seat 312 may have a curvature. In some embodiments, rail seat 312 may be canted at an angle sloping from the field side (outside) toward the gauge side (inside) along the width dimension W. In an embodiment, rail seat 312 may be canted at a ratio of 1:40. When installed between a rail and a railroad tie (sleeper), an embodiment may cause a rail resting on rail seat 312 to be angled toward the gauge side (inside) of the railroad track.

Various embodiments of tie plate 30 may be dimensioned to accommodate a rail flange of width between 5 inches and 7 inches. Particular embodiments may be dimensioned for use with 6 inch rail. Other embodiments may be dimensioned for use with 5.5 inch rail. Still other embodiments may be dimensioned for use with 100-8 base rail.

Flange 340 is on the field side (outside) along the width direction W of tie plate 30. Flange 360 is on the gauge side (inside) along the width direction W of tie plate 30. Each of flanges 340 and 360 may include one or more spike holes 314 and one or more screw holes 316. Spike holes 314 may have a generally rectangular shape, for instance a square shape, to accommodate railroad spikes to be driven through each spike hole 314 into a railroad tie (sleeper). Screw holes 316 may have a generally circular shape to accommodate railroad screws to be driven through each screw hole 316 into a railroad tie (sleeper). In some embodiments only spikes or only screws may be used. In other embodiments both spikes and screws may be used. In some embodiments spikes may be inserted through spike holes 314 as an initial means of fixing tie plate 30 to a railroad tie (sleeper) and screws may be inserted later in a subsequent securing step.

Insertion and tightening of one or more spikes or screws may be accomplished manually or by means of automated machinery in accordance with various embodiments.

In various non-limiting embodiments, spike holes 314 may have side lengths from 0.5 inches to 1.5 inches, or approximately 0.6875 inches and screw holes 316 may have diameters from 0.5 inches to 1.5 inches, or approximately 1 inch. In various non-limiting embodiments, field side flange 340 may have a thickness at field side end 304 from 0.25 inches to 1 inch, or approximately 0.5 inches and gauge side flange 360 may have a thickness at gauge side end 306 from 0.25 inches to 1 inch, or approximately 0.5 inches. According to some embodiments, field side flange 340 may have a uniform thickness. In other embodiments, flange 340 may have a variable thickness. According to some embodiments, gauge side flange 360 may have a uniform thickness. In other embodiments, flange 360 may have a variable thickness. In some embodiments, a thicknesses of flange 340 may be substantially equal to a thickness of flange 360. In other embodiments, thicknesses of flanges 340 and 360 may differ.

According to some embodiments, field side end face 304 may be essentially vertical, forming a step. In some embodiments, gauge side end face 306 may be essentially vertical, forming a step. In other embodiments, end faces 304, 306 may be sloped.

In accordance with various embodiments, field side flange 340 may include flat surface 342 extending along field side end 304 between front edge 308*a* and rear edge 308*b*. In accordance with various embodiments, gauge side flange 360 may include flat surface 362 extending along gauge side end 306 between front edge 308*a* and rear edge 308*b*.

Still referring to FIGS. 16-19, field side flange 340 includes field side shoulder 344 extending upward from flange 340 in thickness dimension T. Field side shoulder 344 further includes field side rib 348 which further extends upward in thickness dimension T from shoulder 344. Rib 348 includes lateral wall 348*a* extending along lengthwise dimension L. Lateral wall 348*a* may provide support to a field side (outside) edge of a railroad rail when the rail is seated on rail seat 312.

In various non-limiting embodiments, field side shoulder 344 may extend from 0.0625 inches to 0.75 inches, or approximately 0.5 inches in the thickness dimension; field side rib 348 may extend from 0.125 inches to 0.75 inches, or approximately 0.5 inches in the thickness dimension; lateral wall 348*a* may have a height from 0.125 inches to 0.75 inches, or approximately 0.5 inches.

Field side flange 340 further includes field side arch 350 which extends upward in thickness direction T from field side flange 340. Arch 350 is a protrusion. Arch 350 is open on at least one of transverse walls 352*a* and 352*b* such that clip-accommodating hole 355 is formed along lengthwise dimension L of arch 350. Clip-accommodating hole 355 is a retaining device accommodating portion. Clip-accommodating hole 355 has a size and shape to accommodate a portion of a retaining device or clip, such as an e-clip. A retaining device or clip, when inserted into clip-accommodating hole 355, may overlap a widthwise portion of a rail, thereby securing the rail in rail seat 312.

In various non-limiting embodiments, field side arch 350 may extend from 1 inch to 4 inches in the thickness dimension, or approximately 2 inches above field side flange 340, and outside radius r11 (FIG. 18) of field side arch 350 may be from 0.75 inches to 1.5 inches, or approximately 1 inch. In other embodiments, arch 350 may have side profiles other than curved, such as square. That is, a protrusion having a retaining device accommodating portion in accordance with various embodiments is not limited to a curved arch shape.

In some embodiments field side buttress 354 extends upward in thickness dimension T from flange 340. Buttress 354 is adjacent to arch 350 on the field side (outside). Buttress 354 may provide support to arch 350. In some embodiments, field side buttress 354 may include one or more field side arch supports. In other embodiments, field side arch supports may be omitted.

In various non-limiting embodiments, field side buttress 354 may extend from 0.25 to 1.5 inches in the thickness dimension, or approximately 1 inch. In accordance with various embodiments, lateral face 354*a* of field side buttress 354 may slope away from field side arch 350 toward the field end of tie plate 30. In other embodiments, lateral face 354*a* may be essentially vertical.

Still referring to FIGS. 15-18, gauge side flange 360 includes gauge side shoulder 364 extending upward from flange 360 in thickness dimension T. Gauge side shoulder 364 further includes gauge side rib 368 which further extends upward in thickness dimension T from shoulder 364. Rib 368 includes lateral wall 368*a* extending along lengthwise dimension L. Lateral wall 368*a* may provide support to a gauge side (inside) edge of a railroad rail when the rail is seated on rail seat 312.

In various non-limiting embodiments, gauge side shoulder 364 may extend from 0.0625 inches to 0.75 inches, or approximately 0.25 inches in the thickness dimension, gauge side rib 368 may extend from 0.125 inches to 0.75 inches, or approximately 0.5 inches in the thickness dimension; lateral wall 368*a* may have a height from 0.125 inches to 0.75 inches, or approximately 0.5 inches.

Gauge side flange 360 further includes gauge side arch 370 which extends upward in thickness direction T from gauge side flange 360. Arch 370 is a protrusion. Arch 370 is open on at least one of transverse walls 372*a* and 372*b* such that clip-accommodating hole 375 is formed along lengthwise dimension L of arch 370. Clip-accommodating hole 375 is a retaining device accommodating portion. Clip-accommodating hole 375 has a size and shape to accommodate a portion of a retaining device or clip, such as an e-clip. A retaining device or clip, when inserted into clip-accommodating hole 375, may overlap a widthwise portion of a rail, thereby securing the rail in rail seat 312.

In various non-limiting embodiments, gauge side arch 370 may extend from 1 inch to 4 inches in the thickness dimension, or approximately 2 inches above gauge side flange 360 and outside radius r5 (FIG. 4) of gauge side arch 370 may be from 0.75 inches to 1.5 inches, or approximately 1 inch. In other embodiments, arch 370 may have side profiles other than curved, such as square. That is, a protrusion having a retaining device accommodating portion in accordance with various embodiments is not limited to a curved arch shape.

In some embodiments gauge side buttress 374 extends upward in thickness dimension T from flange 360. Buttress 374 is adjacent to arch 370 on the gauge side (inside). Buttress 374 may provide support to arch 370. In some embodiments, gauge side buttress 374 may include one or more gauge side arch support. In other embodiments, gauge side arch supports may be omitted.

In various non-limiting embodiments, gauge side buttress 374 may extend from 0.25 to 1.5 inches in the thickness dimension, or approximately 1 inch. In accordance with various embodiments, lateral face 374*a* of gauge side buttress 374 may slope away from gauge side arch 370 toward the gauge end of tie plate 30. In other embodiments, lateral face 374*a* may be essentially vertical.

Referring now to FIG. 15, field side arch 350 has outside radius r11. Arch 350 includes field side arch indentation 357 on its bottom side. In accordance with various embodiments, indentation 357 (and arch 350) may be formed through a metalworking process in which a lug or protuberance of predetermined size is compressed against bottom surface 302 in order to deform bottom surface 302 upward in the thickness direction.

Still referring to FIG. 15, gauge side arch 370 has outside radius r12. Arch 370 includes gauge side indentation 377 on its bottom side. In accordance with various embodiments, indentation 377 (and arch 370) may be formed through a metalworking process in which a lug or protuberance of predetermined size is compressed against bottom surface 302 in order to deform bottom surface 302 upward in the thickness direction.

Referring again to FIGS. 15 and 16-19, field side rib 348 is higher in thickness dimension T than gauge side rib 368. That is, a first distance along thickness dimension T measured from bottom surface 302 to an apex or pinnacle of rib 348 is greater than a second distance along thickness dimension T measured from bottom surface 302 to an apex or pinnacle of rib 368. In some embodiments, an imaginary line connecting a pinnacle of rib 348 to a pinnacle of rib 368 has an inclination matching an inclination of rail seat 312. For example, where rail seat 312 is canted at a ratio of 1:40, the imaginary line between ribs 348 and 368 may be parallel to rail seat 312, having a slope corresponding to a 1:40 ratio.

Still referring to FIGS. 15 and 16-19, field side clip-accommodating hole 355 is higher in thickness dimension T than gauge side clip-accommodating hole 375. That is, a first distance along thickness dimension T measured from bottom surface 302 to an apex or pinnacle of clip-accommodating hole 355 is greater than a second distance along thickness dimension T measured from bottom surface 302 to an apex or pinnacle of clip-accommodating hole 375. Consequently, a first clip or other retaining device installed in clip-accommodating hole 355 may sit higher than a second clip or other retaining device installed in clip-accommodating hole 375. In some embodiments, an imaginary line connecting a pinnacle of hole 355 to a pinnacle of hole 375 has an inclination matching an inclination of rail seat 312. For example, where rail seat 312 is canted at a ratio of 1:40 in relation to bottom surface 302, the imaginary line between arches 350 and 370 may be parallel to rail seat 312, having a slope corresponding to a 1:40 ratio in relation to bottom surface 302.

Referring again to FIGS. 15-18, in some embodiments, transverse wall 352*a* may be coplanar with front edge 308*a*. Likewise, transverse wall 372*b* may be coplanar with rear edge 308*b*. In other embodiments, transverse wall 352*a* may be adjacent to front edge 308*a* without being coplanar with front edge 308*a*. In some embodiments, field side arch 350 may be closer to front edge 308*a* than to rear edge 308*b*. In other embodiments, field side arch 350 may be closer to rear edge 308*b* than to front edge 308*a*. Likewise, in some embodiments, gauge side arch 370 may be closer to front edge 308*a* than to rear edge 308*b*. In other embodiments, gauge side arch 370 may be closer to rear edge 308*b* than to front edge 308*a*. In various embodiments, field side arch 350 may be offset from front edge 308*a* and gauge side arch 370 may be offset from rear edge 308*b*, with field side arch 350 being offset a same distance from front edge 308*a* as gauge side arch 370 is offset from rear edge 308*b*. In other embodiments, arches 350 and 370 may be offset by different distances. In other embodiments, field side arch 350 may be offset from front edge 308*a* by any suitable distance and gauge side arch 370 may be offset from rear edge 308*b* by any suitable distance.

In some embodiments, a first distance in length dimension L between transverse wall 352*a* and front edge 308*a* may be different from a second distance in length dimension L between transverse wall 352*b* and rear edge 308*b*. Likewise, in some embodiments, a third distance in length dimension L between transverse wall 372*a* and front edge 308*a* may be difference from a fourth distance in length dimension L between transverse wall 372*b* and rear edge 308*b*.

at least one of arches 350 and 370 is closer to one of rear edge than to front edge Field side arch 350 may extend across a portion of tie plate 30 less than the overall length of tie plate 30. Gauge side arch 370 may extend across a portion of tie plate 30 less than the overall length of tie plate 30. Accordingly, bottom surface 302 may be continuous across one or more width portions of tie plate 30 corresponding to one or more length portions of tie plate 30 not occupied by arch 350 and not occupied by arch 370.

In some embodiments, one or more spike holes 314 or screw holes 316 may be located to overlap with arch 350 in the length direction. That is, one or more spike holes 314 or screw holes 316 may be opposite arch 350 in the width direction. Similarly, one or more spike holes 314 or screw holes 316 may be located to overlap with arch 370 in the length direction. That is, one or more spike holes 314 or screw holes 316 may be opposite arch 370 in the width direction.

Referring to FIGS. 16-19, in some embodiments, clip-accommodating holes 355 and 375 may be formed by one or more forging processes. In other embodiments, holes 355 and 375 may be formed by one or more material removal processes, such as milling or drilling.

Advantageously, railroad tie plates in accordance with various embodiments may be inexpensive to produce and may have superior mechanical properties. Thus, embodiments may have superior resistance to failure by fatigue and cracking.

Thus, the foregoing discussion discloses and describes merely exemplary embodiments. As will be understood by those skilled in the art, the present disclosure may be embodied in other specific forms without departing from the spirit or essential characteristics thereof. Features discussed with respect to a particular embodiment are not limited to that embodiment, but may be combined with or substituted for other features of other embodiments. Accordingly, the disclosure is intended to be illustrative, but not limiting of the scope of the claims or of other embodiments covered by the claims. The disclosure, including any readily discernible variants of the teachings herein, define, in part, the scope of the foregoing claim terminology such that no inventive subject matter is dedicated to the public.

What is claimed is:

1. A railroad tie plate comprising:

a generally prismatic body extending in a width dimension of the tie plate between a field side end and a gauge side end;

a field side flange on the field side end, the field side flange extending from a bottom surface of the tie plate in a thickness dimension of the tie plate;

a gauge side flange on the gauge side end, the gauge side flange extending from the bottom surface of the tie plate in the thickness dimension of the tie plate;

an intermediate portion extending between the field side flange and the gauge side flange, the intermediate portion including a rail seat configured to receive a railroad rail, wherein at least one of the field side flange and the gauge side flange comprises a fixing portion configured to receive a fixing device for securing the tie plate to a railroad tie, at least one of the field side flange and the gauge side flange comprises a first protrusion extending in the thickness dimension of the tie plate and a buttress adjacent to the first protrusion on a side opposite the intermediate portion, the first protrusion having a first retaining device accommodating portion configured to receive a first retaining device for securing a railroad rail to the rail seat and the buttress having at least one support on top of the buttress along the width dimension and extending upward in the thickness dimension of the tie plate from the buttress, the gauge side flange, the field side flange, the intermediate portion, and the first protrusion comprise pearlite and alpha-ferrite, and wherein the at least one support has a top surface beveled at an angle sloping toward a front edge or a rear edge of the tie plate.

2. The railroad tie plate of claim 1, wherein the gauge side flange, the field side flange, the intermediate portion, and the first protrusion further comprise a microstructure substantially free of monotectoid.

3. The railroad tie plate of claim 1, wherein the gauge side flange, the field side flange, the intermediate portion, and the first protrusion further comprise equiaxed grains.

4. The railroad tie plate of claim 1, wherein a reduction of area at fracture of the railroad tie plate is greater than or equal to 50%.

5. The railroad tie plate of claim 1, wherein an elongation at break of the railroad tie plate is greater than or equal to 22%.

6. The railroad tie plate of claim 1, wherein a yield strength of the railroad tie plate is greater than or equal to 400 MPa.

7. The railroad tie plate of claim 1, wherein an ultimate tensile strength of the railroad tie plate is greater than or equal to 650 MPa.

8. The railroad tie plate of claim 1, wherein the field side flange comprises the first protrusion, the gauge side flange comprises a second protrusion comprising a second retaining device accommodating portion configured to receive a second retaining device for securing a railroad rail to the rail seat, and the second protrusion comprises pearlite and alpha-ferrite.

9. The railroad tie plate of claim 1, wherein the fixing portion comprises a hole extending through the railroad tie plate in the thickness dimension of the tie plate.

10. The railroad tie plate of claim 1, wherein the first retaining device accommodating portion comprises a hole extending into the first protrusion along a length dimension of the tie plate.

11. A railroad tie plate comprising:

a generally prismatic body extending in a width dimension of the tie plate between a field side end and a gauge side end;

a field side flange on the field side end, the field side flange extending from a bottom surface of the tie plate in a thickness dimension of the tie plate, the field side flange comprising a flat surface extending along the field side end between a front edge of the tie plate and a rear edge of the tie plate, at least one of a spike hole and a screw hole extending through the field side flange in the thickness dimension, and a field side protrusion extending from the field side flange in the thickness dimension and a field side buttress adjacent to the field side protrusion on a field side, the field side protrusion comprising a field side clip-accommodating hole extending into the field side protrusion in a length dimension perpendicular to the width dimension and perpendicular to the thickness dimension, and the field side buttress having at least one support on top of the field side buttress along the width dimension and extending upward in the thickness dimension of the tie plate from the field side buttress;

a gauge side flange on the gauge side end, the gauge side flange extending from the bottom surface of the tie plate in the thickness dimension of the tie plate, the gauge side flange comprising a flat surface extending along the gauge side end between the front edge of the tie plate and the rear edge of the tie plate, at least one of a spike hole and a screw hole extending through the gauge side flange in the thickness dimension, and a gauge side protrusion extending from the gauge side flange in the thickness dimension and a gauge side buttress adjacent to the gauge side protrusion on a gauge side, the gauge side protrusion comprising a gauge side clip-accommodating hole extending into the gauge side protrusion in the length dimension and the gauge side buttress having at least one support on top of the gauge side buttress along the width dimension and extending upward in the thickness dimension of the tie plate from the gauge side buttress;

an intermediate portion extending between the field side flange and the gauge side flange, the intermediate portion comprising a rail seat to receive a railroad rail; and wherein the at least one support of the gauge side buttress, the at least one support of the field side buttress, or both have a top surface beveled at an angle sloping toward the front edge or the rear edge of the tie plate.

12. The railroad tie plate of claim 11, wherein at least one of the field side protrusion and the gauge side protrusion comprises an indentation extending from the bottom surface of the tie plate.

13. The railroad tie plate of claim 11, wherein at least one of the field side protrusion and the gauge side protrusion is closer to at least one of a rear edge and a front edge of the tie plate than to another of the rear edge and the front edge.

14. The railroad tie plate of claim 11, further comprising:

a field side shoulder extending from the field side flange in the thickness dimension of the tie plate, the field side shoulder overlapping the field side protrusion in the width dimension of the tie plate and a gauge side shoulder extending from the gauge side flange in the thickness dimension of the tie plate, the gauge side shoulder overlapping the gauge side protrusion in the width dimension of the tie plate.

15. The railroad tie plate of claim 14, further comprising:

a field side rib extending from the field side shoulder in the thickness dimension of the tie plate, the field side rib having a lateral wall facing toward the gauge side end of the tie plate and a gauge side rib extending upward from the gauge side shoulder in the thickness dimension of the tie plate, the gauge side rib having a lateral wall facing toward the field side end of the tie plate.

16. The railroad tie plate of claim 15, wherein an inclination of an imaginary line between a pinnacle of the field side rib and a pinnacle of the gauge side rib is equal to an inclination of the rail seat.

17. The railroad tie plate of claim 15, wherein an inclination of an imaginary line between a pinnacle of the field side clip-accommodating hole and a pinnacle of the gauge side clip-accommodating hole is equal to an inclination of the rail seat.

18. The railroad tie plate of claim 11, wherein the field side flange comprises a stepped edge at the field side end of the tie plate and the gauge side flange comprises a stepped edge at the gauge side end of the tie plate.

* * * * *